US011535980B2

(12) United States Patent
Ronchi

(10) Patent No.: US 11,535,980 B2
(45) Date of Patent: Dec. 27, 2022

(54) MULTIFUNCTIONAL CONTINUOUS DYEING APPARATUS OF WARP CHAINS FOR FABRICS

(71) Applicant: KARL MAYER R&D GMBH, Obertshausen (DE)

(72) Inventor: Francesco Ronchi, Sovico (IT)

(73) Assignee: KARL MAYER STOLL R&D GMBH, Obertshausen (DE)

( * ) Notice: Subject to any disclaimer, the term of this patent is extended or adjusted under 35 U.S.C. 154(b) by 374 days.

(21) Appl. No.: 16/087,736

(22) PCT Filed: May 29, 2017

(86) PCT No.: PCT/IB2017/053151

§ 371 (c)(1),
(2) Date: Sep. 24, 2018

(87) PCT Pub. No.: WO2017/208134

PCT Pub. Date: Dec. 7, 2017

(65) Prior Publication Data

US 2020/0299896 A1 Sep. 24, 2020

(30) Foreign Application Priority Data

May 30, 2016 (IT) ..... 102016000055598

(51) Int. Cl.
*D06P 1/22* (2006.01)
*D06B 3/06* (2006.01)
(Continued)

(52) U.S. Cl.
CPC ..... *D06P 1/222* (2013.01); *D06B 3/06* (2013.01); *D06B 19/0052* (2013.01);
(Continued)

(58) Field of Classification Search
CPC ..... D06P 1/222; D06P 5/001; D06P 5/2055; D06B 3/06; D06B 19/0052; D06B 21/02; D06B 23/14
(Continued)

(56) References Cited

U.S. PATENT DOCUMENTS 1,399,230 A * 12/1921 Sullivan ..... D06B 3/04 68/27
1,500,894 A 7/1924 Robertson et al.
(Continued)

FOREIGN PATENT DOCUMENTS

CN 1165646 A 11/1997
CN 1209477 A 3/1999
(Continued)

OTHER PUBLICATIONS

CN Office Action dated Jun. 5, 2020 re: Application No. 201780025584.X, pp. 1-22, citing: CN101107393A, CN2832846Y, CN1242059A and CN201183344Y.
(Continued)

*Primary Examiner* — David G Cormier
*Assistant Examiner* — Thomas Bucci
(74) *Attorney, Agent, or Firm* — Cantor Colburn LLP

(57) ABSTRACT

A multifunctional continuous dyeing apparatus provided at a bottom with a main body within which are formed in a sequence, with reference to the feeding direction of the yarn, at least a first dyeing group for the yarn, provided with a respective first squeezing device of the yarn, an oxidation or diffusion/fixation group, placed downstream of the first dyeing group and arranged for the oxidation of the dyed yarn or for the diffusion/fixation of the dye in the fiber of the dyed yarn, and at least a second dyeing group of the yarn, arranged downstream of the oxidation or diffusion/fixation group and in turn provided with a respective second squeez-
(Continued)

ing device of the yarn, where at least the first dyeing group, the first squeezing device, the oxidation or diffusion/fixation group and the second dyeing group are hermetically sealing enclosed by at least one covering case, integral at the top with the main body, and provided with a plurality of doors which are at least partially openable to perform the dyeing of the yarn in an environment exposed to air and which are reclosable to perform the dyeing of the yarn in an inert environment under nitrogen.

15 Claims, 13 Drawing Sheets

(51) Int. Cl.

| | |
|---|---|
| ***D06B 19/00*** | (2006.01) |
| ***D06B 21/02*** | (2006.01) |
| ***D06B 23/14*** | (2006.01) |
| ***D06P 5/00*** | (2006.01) |
| ***D06P 5/20*** | (2006.01) |

(52) U.S. Cl.
CPC ..... *D06B 21/02* (2013.01); *D06B 23/14* (2013.01); *D06P 5/001* (2013.01); *D06P 5/2055* (2013.01)

(58) Field of Classification Search
USPC ..... 68/3 R
See application file for complete search history.

(56) References Cited

U.S. PATENT DOCUMENTS 3,415,083 A * 12/1968 Okazaki ..... D06B 23/16 68/5 E
3,530,693 A 9/1970 Dimond et al.
3,918,111 A * 11/1975 Dunn ..... D06B 3/04 8/149.1
3,986,831 A * 10/1976 von der Eltz ..... D06B 1/145 8/149.1
4,118,183 A * 10/1978 Godau ..... D06P 1/22 8/151.2
4,173,077 A * 11/1979 Birke ..... F26B 13/24 34/222
4,231,129 A * 11/1980 Winch ..... D06B 21/00 8/149.1
4,313,235 A * 2/1982 Gotovtseva ..... D06M 11/38 8/149.1
4,472,950 A * 9/1984 Sando ..... D06B 23/16 68/5 E
4,517,818 A * 5/1985 Sando ..... D06B 23/16 68/18 F
4,775,086 A 10/1988 Kataoka
5,199,126 A * 4/1993 Fuller ..... D06B 19/0005 8/930
5,201,959 A * 4/1993 Fuller ..... D06B 19/0005 68/9
5,337,586 A * 8/1994 Ronchi ..... D06B 3/04 68/5 D
5,815,867 A * 10/1998 Keasler ..... D06B 11/0079 8/149.1
5,922,084 A * 7/1999 Fuchs ..... D06B 3/10 8/149.1
5,942,006 A * 8/1999 Cole ..... D06M 13/285 8/115.64
6,123,741 A * 9/2000 Girbaud ..... D06B 21/00 8/918
6,355,073 B1 * 3/2002 Godau ..... D06B 3/18 8/149.1
6,485,566 B1 11/2002 Christian et al.
7,235,110 B2 * 6/2007 Alpert ..... D06P 1/5278 8/930
D654,963 S 2/2012 Powers et al.
8,182,712 B1 * 5/2012 Maekawa ..... D06B 3/20 252/62.51 R
8,925,935 B2 1/2015 Powers et al.
D806,176 S 12/2017 Peng
D829,826 S 10/2018 Liu et al.
D839,358 S 1/2019 Cao
D849,153 S 5/2019 Zhang et al.
D858,646 S 9/2019 Yang
D858,647 S 9/2019 Liu et al.
D860,917 S 9/2019 Tan et al.
2005/0028303 A1 * 2/2005 Wroblowski ..... D06B 3/18 8/445
2008/0040870 A1 * 2/2008 Ronchi ..... D06B 3/18 8/151.2
2009/0000042 A1 * 1/2009 Ronchi ..... D06B 21/00 68/21

FOREIGN PATENT DOCUMENTS

CN 1242059 A 1/2000
CN 2832846 Y 11/2006
CN 101107393 A 1/2008
CN 201183344 Y 1/2009
CN 101389801 A 3/2009
CN 102605582 A 7/2012
CN 103938387 A 7/2014
CN 104532501 A 4/2015
CN 105463730 A 4/2016
DE 4342313 A1 6/1995
EP 0533286 A1 3/1993
EP 0799924 A2 10/1997
EP 1971713 A 9/2008
GB 1430154 3/1976
JP S4638631 A 11/1971
JP S62257480 A 11/1987
JP 1046466 A 2/1998
JP 2001518989 A 10/2001
JP 2002061068 A 2/2002
JP 2002281136 A 9/2002
JP 2008503437 A 3/2008
JP 2009523200 A 6/2009
WO 0174481 A1 10/2001
WO 2006013458 A1 2/2006
WO WO 2006/013458 * 2/2006
WO 2006106533 A1 10/2006
WO 2007080134 A1 7/2007

OTHER PUBLICATIONS

EP Examination Report dated Mar. 11, 2020, pp. 1-7. citing: US 2008/040870 A1, U.S. Pat. No. 5,942,006 A and WO 01/74481 A1.
International Search Report for corresponding application PCT/IB2017/052845 filed May 15, 2017; dated Sep. 6, 2017.
International Search Report for corresponding application PCT/IB2017/053151 filed May 29, 2017; dated Aug. 29, 2017.
Written Opinion of the International Searching Authority for corresponding application PCT/IB2017/052845 filed May 15 2017; dated Sep. 6, 2017.
Written Opinion of the International Searching Authority for corresponding application PCT/IB2017/053151 filed May 29, 2017; dated Aug. 29, 2017.
JP Office Action dated Jan. 7, 2021, re: Application No. 2018-555591, pp. 1-4, citing: CN1045320501, JPS46-038631A, JPH10-046466A, JP2001-518989A, JP2002-281136A, U.S. Pat. No. 6355073, CN1165646.
JP Office Action dated Jan. 7, 2021 re: Application No. 2018-554703, pp. 1-4, citing: JP2008-508437A, JP2009-523200A, JPS62-257480A, JP2002-061068A, U.S. Pat. No. 5337586, US2009/0000042, CN101389801.

* cited by examiner (TECNICA NOTA)

MULTIFUNCTIONAL CONTINUOUS DYEING APPARATUS OF WARP CHAINS FOR FABRICS

TECHNICAL FIELD

The disclosure generally relates to a plant for the continuous dyeing of warp chains for fabrics and, in particular, to a process and a multifunction dyeing apparatus with indigo and/or other dyes to which yarn chains for the warp of denim fabrics are continuously subjected. More in particular, the present disclosure relates to a process and a multifunctional continuous dyeing apparatus that work with reduction baths.

BACKGROUND

A typical application of such apparatus is that of the continuous dyeing of warp chains for denim fabrics with indigo or other dyes. Denim is the fabric used for making jeans and "sportswear" articles in general, and is quantitatively the most used fabric in the world.

The success of the denim-blue jeans union is due precisely to the dyeing of the warp of this fabric with indigo. Indigo is one of the oldest dyes, not easily applied to cotton for which it has poor affinity, but which has a unique feature that makes the fabric, and as a result the garment, have a shiny and pleasant appearance over time. Blue jeans are in fact appreciated for their typical Navy tone that gradually, because of repeated washings, takes on a lighter tone until it reaches a bright blue. As far as we know, no other dye has similar properties. Other classes of dyes, after many washes, turn towards dirty grey, or stain the white yarn with an unpleasant blue/grey color. The above peculiarity, together with that look of vintage garment, which is evident with the abrasion in exposed areas and that creates a plastic effect on the wearer's body, are the charm of blue jeans, which manufactured and treated in many ways are and will remain the world's top-selling garment.

One of the features of indigo dye, which makes it unique, is the particular dyeing method required for its application to the cotton yarn. This dyeing method has remained virtually unchanged since the time of vegetable dye to the present day, in over one hundred years since its synthesis.

The indigo dye, due to the relatively small molecule and low affinity with cellulose fiber, in order to be applied must not only be reduced in alkaline solution (leuco), but it also requires being subjected to a plurality of impregnations alternated with squeezing and subsequent air oxidation. In practice, a medium or dark color tone is obtained only by subjecting the yarn to a first dyeing (impregnation, squeezing, oxidation) immediately followed by multiple overdyeing, the more numerous the darker the tones and the higher the required color fastness.

This particular dyeing method, typical of the indigo dye, dramatically highlights the importance of compliance with certain basic parameters related to the immersion and oxidation times. This is to allow the dye to impregnate and evenly distribute in the cortical or surface layer of the yarn (ring dyeing) and, after a perfect squeezing, to oxidize completely before entering the next tank, so as to "remount", i.e. intensify the color tone.

Unfortunately, in addition to these parameters, continuous dyeing with indigo is also influenced by many other factors relating to the different physical-chemical contexts of each individual plant, and the environmental conditions where the plant itself is installed, such as temperature and relative humidity of the air, upwind condition, altitude, etc. In addition, the different dyeing conditions (such as number of tanks, their capacity, pick up, circulation rate and type of the dye bath, type and accuracy of the automatic indigo, caustic soda and sodium hydrosulphite dosing systems, etc.) and the different conditions of the dye bath (such as temperature, concentration, pH, Redox potential, etc.) not only have a decisive impact on the dyeing results (such as greater or smaller dyeing intensity, color fastness, corticality, etc.), but also contribute considerably to determine the final appearance of the garments after the various washing and finishing treatments to which they are normally subjected. It should also be noted that, in contrast to other groups of dyes for which affinity for cotton increases with increasing temperature, the color affinity and depth with indigo, the latter due to greater dye corticality, increase with decreasing temperature.

The most important and qualifying operation of the entire production cycle of denim tissue is that of continuous dyeing, with indigo dye and/or with other dyes, of the warp yarn chains before they are put on the loom to produce the fabric. Classic denim is in fact manufactured by weaving pre-dyed cotton threads. In particular, only the warp is dyed, while the weft is used raw.

The continuous dyeing of warp chains for denim fabrics is mainly carried out according to two systems, namely the so-called "rope" system and the so-called "flat" or "wide" system. The two systems above, despite differing substantially, however, in the case of dyeing with indigo share the use of the same dyeing method, consisting essentially of three operational steps that are repeated several times: yarn impregnation with the reduced dye, squeezing to remove the excess dye bath and dye oxidation by exposure of the dyed yarn to air.

Typically and traditionally, dyeing the warp chains for denim fabrics with indigo is carried out, both in the rope system and in the wide system, in open and low temperature tanks. In detail, in the two systems, the continuous dyeing plants with indigo typically consist of 3-4 pretreatment tanks, 8-10 dyeing tanks and 3-4 final washing tanks. All tanks are provided with a squeezing group to remove the excess dye bath, while the dyeing tanks are also provided with groups of rollers exposed to air for the oxidation of the yarn.

The dyeing tanks are of the open type, each of which has a dye bath capacity ranging from 1000 to 4000 liters, containing about 4-11 meters of yarn. These amounts of dye bath determine the total volume of the bath circulating in the plant, which then can range from about 10,000 to 40,000 liters. The dye bath contained in each tank is recycled continuously to ensure homogeneity of concentration in each tank. This circulation is normally carried out by various known piping systems, with high capacity and low pressure centrifugal pumps to prevent harmful turbulence. The movement of the dyeing bath results in the continuous renewal of the superficial part of the bath itself, which is in contact with the air, the tanks being open at the top, and then it causes the oxidation thereof. The dye bath oxidation results in the continuous depletion of the reducing agents contained therein, i.e. sodium hydrosulphite and caustic soda, and this to a greater extent the higher the temperature of the dye bath.

However, the several oxidation steps concur, to a greater extent than mentioned above, to deplete the dye bath of the same elements (sodium hydrosulphite and caustic soda) which impregnate the yarn are multiple. These oxidation steps are an integral part of the dyeing cycle and basically consist of an exposure to air, between one tank and the other of the 6-10 dyeing tanks of the plant, of about 30-40 meters of yarn impregnated with leuco. The yarn is therefore overall exposed to air for several hundred meters throughout the dyeing plant.

Based on the foregoing, it is necessary to continuously replenish the dye bath with the amounts of caustic soda and sodium hydrosulphite destroyed by the above oxidation, so that such a dye bath is constantly maintained in optimal chemical conditions for the best dyeing yield and to ensure consistent and reproducible results. These continuous additions to the dye bath constitute a considerable economic cost, increase the salinity of the dye bath itself, with consequent dyeing problems, and also create a remarkable final washing water pollution.

Of course, the dye bath must also be continually and constantly admixed with dye, in condition of concentrated leuco, in the amount necessary to obtain the desired color tone. For the automatic continuous dosing of the indigo dye, caustic soda and sodium hydrosulphite, various systems may be used such as dosing pumps, weighing, volumetric, mass systems, etc., however all known as normally used also in other textile processes.

Of course, the higher the volume of the dye bath, the more time is required to bring a new dye bath to the chemical/dyeing balance needed to constantly obtain the same color tone. Equally long will be the response time to any corrective actions, and this does not help the achievement of quality.

Another peculiarity of the indigo dye is due to the fact that dye baths with this dye are never substituted, if not to change the color tone. As mentioned above, indigo dye baths are instead continually reused by adding sodium hydrosulphite, caustic soda and dye in order to maintain constant the chemical/dyeing balance thereof. Each dyeing plant then has a certain number, equal to the number of variants of blue in production, of containers with a total capacity of all the dyeing tanks. These containers are used for storage and reuse of the dye baths.

For quality purposes, it is of the utmost importance to be able to keep the physical and chemical conditions of the dye bath constant for all the time needed to dye the entire batch of yarn. The average time is between 15 hours and 30 hours depending on the yarn chain length and the dyeing rate. Unfortunately, despite ongoing mechanical and hydraulic improvements of the dyeing plants and the use of sophisticated control and dosing systems, for the large volumes involved, as well as for the many reasons outlined above, which individually or in combination can contribute to creating undesired variations of the conditions of the dye bath, continuous dyeing with indigo remains a complex operation.

Besides the foregoing, in the flat dyeing system the length of yarn threaded into the dyeing/sizing line, which can reach 500-600 meters, makes it difficult to control the plant. In the flat system there is also an economic drawback due to the amount of yarn that is lost at each batch change. In this operating condition, in fact, all the amount of yarn mentioned above, which forms the tail of the yarn batch, whose dyeing has ended and that remains in the plant after its stoppage, must be considered as lost, as it is not evenly dyed. Likewise, also the same amount of yarn which forms the beginning of a new batch and which, connected to the tail yarn, replaces it in passing the dyeing plant (made at low speed for safety and technical requirements) is not evenly dyed and must therefore be discarded.

In addition, further complicating the production of denim fabric was the addition of various economic and ecological problems, also aggravated by the fact that the production of this fabric is extremely diversified and is carried out in batches of shorter lengths. This factor is the result of the fact that, compared to what happened in the past, denim fabric is increasingly used in the fashion industry, where not only a significant operational flexibility and timeliness of production are required, but there are also constant requests for new original and exclusive articles to stimulate sales, to win the competition and gain new markets.

In fact, over time, denim fabric has undergone a remarkable and constant evolution, moving from an initial production with warp dyed with indigo only up to the addition of several manufacturing operations, such as caustic soda pre-treatment, pre-dyeing, over-dyeing, etc., which entailed the completion of the dyeing plants with respective aggregated devices. Important changes have occurred also in the yarns employed, from cotton alone to various mixtures of fibers, from the open end cotton to the so-called ring spun cotton, from large to fine textile measures, as well as elastic fibers and an increasingly higher thread count to get increasingly lighter denim.

It is in the finishing operations that in order to follow fashion, there has been a technological revolution that has seen the denim fabric evolve from being used as it was produced on the loom. Washing, mercerizing, over-dyeing by immersion, foaming or coating operations were in fact added, using the latter two systems also for the application of special products in order to vary the appearance of the fabric, especially to achieve particular effects after washing of the garments.

The influence of fashion is even more evident in the jeans industry, where a new productive activity consisting of denim laundries has been created. Once, as described above, the gradual fading of the jeans, an effect that gives a particular tone of bright blue and a pleasant impression of vintage garment, was the natural result of personal use and the resulting multiple washings. These effects, as well as many others, are today already present on new garments and are precisely added by denim laundries that, with a multiplicity of possible pre-treatments, allow the end users to enjoy them immediately. The jeans in laundries are washed, bleached with a variety of chemicals, enzymes, ozone and/or laser, treated with pumice stone, sanded, etc. These treatments give the jeans a vintage look, which goes even to create rips in the fabric.

All these final treatments, whether performed directly on the denim fabric or those performed on the garments, necessarily require that the characteristics of the basic dye, i.e. that of the warp dye, are suitable and concur with them to obtain and highlight the desired effects. It should be noted that many of these treatments, due to the increasing ecological awareness, are now made with less aggressive and less polluting products and consequently underwent a lengthening of the working times. Hence there is the need for the dyeing of the warps to be very intense in color but also very cortical or superficial, so as to reduce the times of these expensive treatments while still providing a good final contrast.

From a dyeing point of view, part of the current requests coming from the fashion industry are possible also on traditional dyeing plants, perhaps using some particular tricks. Other requests coming from the fashion industry are solved only with dyeing plants that use the new dyeing technology in inert atmosphere (under nitrogen) described in patent EP 0799924 B1 and better in patents EP 1771617 B1 and EP 1971713 B1 on behalf of the same Applicant. This new and original working condition, in inert environment, allows eliminating many problems of the traditional indigo dyeing system, with respect to which it has not only the advantage of reducing the number of dyeing tanks, but dramatically reduces also the consumption of caustic soda and sodium hydrosulphite. Moreover, with a better fixation of the dye to the yarn, a substantial saving of washing water is also obtained. In addition, the chemical reduction of indigo under nitrogen is total and perfect and leuco is broken down into particles of nanometric dimensions. This increased dyeing capacity of leuco allows for better penetration and better fixation thereof to the fiber compared to the traditional system, with different dyeing results in terms of fastness, intensity, corticality and lightness, differences that affect the final effects. Moreover, also in the dyeing of sulphur dyes, particularly of the black dye, this new technology has shown greater color rendering, with a significantly higher fixation degree and with better brightness compared to dyes made on traditional plants.

To most producers of denim fabrics, however, it is difficult to propose the combination of this new technology with the traditional dyeing technology with indigo. This not only for the considerable financial commitment and for the large space required, but also for the difficulties arising in production management with two different technologies. In practice, the producers of denim fabrics want to avoid installing dyeing plants with a particular production that, for the reasons above, may not always be used full time. Hence the need to devise a new dyeing technology in terms of new industrial, creative, economic and ecological needs, that require maximum operating flexibility, versatility, production change timeliness as well as management economy and ecological sustainability.

BRIEF SUMMARY

The disclosure provides a multifunctional continuous dyeing apparatus, in air or inert environment, with indigo or other dyes, of rope or flat warp chains for denim fabrics which can solve the above drawbacks of the prior art in an extremely simple, cost-effective and particularly rational and functional manner In more detail, the disclosure provides a multifunctional dyeing apparatus that, in one or more samples, can be used in continuous dyeing processes with indigo and which allows carrying them out according to the traditional method, which is in contact with air, and alternatively also in an inert environment.

The disclosure further provides a multifunctional dyeing apparatus that is capable to reduce the number of the tanks normally used by the prior art plants, with the consequent economic advantages, but also able to operate so as to reduce scrap at each batch change.

The disclosure further provides a multifunction dyeing apparatus that is able to operate in an inert environment, allowing a significant reduction, in indigo dyeing, of the normal consumption of sodium hydrosulphite and caustic soda.

The disclosure also provides a multifunctional dyeing apparatus that allows dyeing in optimal technological conditions and that allows increasing the diffusion and fixation of the dye to the fiber.

The disclosure further provides a multifunctional dyeing apparatus that allows upgrading the traditional dyeing plants by including one or more multifunctional apparatuses that allow special dyeing, such as with black sulphur dye.

The disclosure generally provides a multifunctional continuous dyeing apparatus for yarn chains.

This multifunctional continuous dyeing apparatus in fact combines, in a simple and rational manner, the traditional technology of dyeing with indigo, carried out in contact with air, with the new dyeing technology in an inert environment, in its two different application methods, with all the relative advantages and benefits. Depending on the needs, this multifunctional continuous dyeing apparatus can alternatively employ air technology or that of two methods in nitrogen in a simple, cost-effective and environmentally friendly manner, taking advantage of the combination of their operational flexibility to produce all the wide range of items required.

The multifunctional continuous dyeing apparatus according to the present disclosure can also allow doubling the number of possible dyeing operations, by carrying out the same operations according to the "ring" system of patent GB 1430154. The teachings of patent GB 1430154 would however be applied with a single ring for a plurality of tanks and not with a plurality of rings in a single tank, thus obtaining the relative dyeing and economic advantages but annulling the defects that at the time did not allow the expansion of dyeing plants made according to the teachings of such a patent.

It should be noted that the application of the above "ring" system, besides the advantage of being able to halve the number of dyeing tanks used as the use thereof is doubled, also contributes a considerable dyeing improvement. The squeezing groups, operating on two overlapping yarn carpets and thus with a double linear density of threads, in fact guarantee greater residual uniformity of the dye bath, thus significantly mitigating the defect of the different shade of color between the central part and the lateral selvedges, as demonstrated in U.S. Pat. No. 4,118,183. In addition, the ring system, by halving the number of dyeing tanks with the relative groups of oxidation rollers, significantly reduces the amount of yarn threaded in the dyeing apparatus, thus facilitating the conduction of the apparatus and reducing to about a half the amount of yarn to discard at each batch change.

This ring system also adds a further series of technical and economic advantages because, again in relation only to the dyeing tanks, it halves the size, cost, installed power and volume of the dye bath. Ultimately, it is a system that helps making the multifunctional dyeing apparatus according to the present disclosure undoubtedly the most corresponding to all technological requirements and criteria of environmental sustainability.

The multifunctional continuous dyeing apparatus according to the present disclosure can also be provided with oxidation devices with variable and retrievable capacity as those described in the Italian patent application no. 102016000049954 on behalf of the same Applicant. The objective is to further reduce the amount of yarn that must be discarded at each batch change. Finally, the multifunctional continuous dyeing apparatus according to the present disclosure can work effectively with small batches of yarn, i.e. reduced yarn sizes, increasingly demanded by the market.

Substantially, the multifunctional continuous dyeing apparatus for yarn chains according to the present disclosure is designed to work with indigo or other dyes and is of the type provided with at least a first dyeing group, provided with a relative squeezing device, a central group designed for the oxidation of the dyed yarn, in the case of dye in the air, and/or designed for the diffusion/fixation of the dye in the fiber, in the case of dyeing under nitrogen. In addition, the apparatus is provided with a second dyeing group, divided into two parts that can be used simultaneously in the case of dye in the air and/or only the second part in the case of dye under nitrogen. This second dyeing group is also provided with a respective squeezing device. All groups of the dyeing apparatus are enclosed by an upper hermetically sealed covering case provided with large lateral windows, to be opened in the case of dyeing in the air, and with sealing devices for the exit of the yarn without loss of nitrogen.

BRIEF DESCRIPTION OF THE DRAWINGS

The features and the advantages of a multifunctional continuous dyeing apparatus for a yarn chains according to the present disclosure will become apparent from the following exemplary and non-limiting description, made with reference to the accompanying schematic drawings, in which.

DETAILED DESCRIPTION

Figure 1:
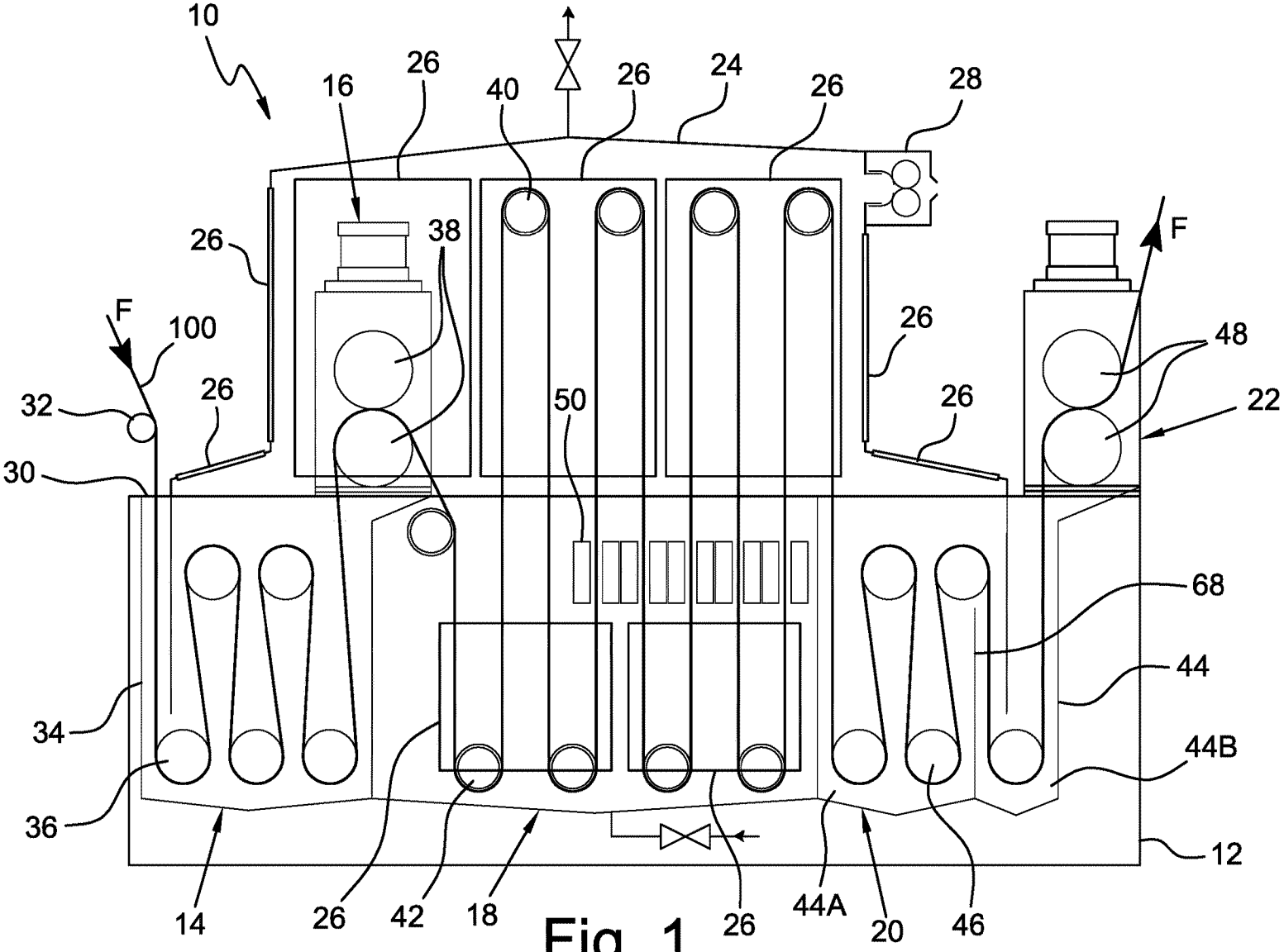
FIG. 1 is a schematic, side elevation view of a multifunctional continuous dyeing apparatus for yarn chains according to the present disclosure, with the yarn threaded in all the groups of the apparatus itself, and with the lateral windows open, for dyeing in the air.

It is noted that in the following description and in the accompanying figures, numerous components, accessories and instruments normally supplied with this type of plants and apparatuses, such as inertisation, filling, discharge, heating, dye bath circulation, dehumidification devices etc. are not shown as they are well known to a person skilled in the art.

With reference to the figures, a multifunctional continuous dyeing apparatus for yarn chains is shown, according to the present disclosure, indicated as a whole with reference numeral 10. In particular, apparatus 10 is configured to dye rope or flat warp chains, for fabrics and is designed to work both with the indigo dye and with other dyes.

The dyeing apparatus 10 is provided at the bottom with a main body 12. Within the main body 12 are obtained in a sequence, with reference to the feeding direction F of a yarn 100, the following processing groups of such a yarn 100:

- at least one first dyeing group 14 for dyeing the yarn 100, provided with a corresponding first squeezing device 16 for squeezing such a yarn 100, and
- an oxidation or diffusion/fixation group 18, placed downstream of the first dyeing group 14 and configured for the oxidation of the dyed yarn 100, in the case of dyeing in the air, or for the diffusion/fixation of the dye in the fiber of such a dyed yarn 100, in the case of dyeing under nitrogen.

The dyeing apparatus 10 then comprises, downstream of the oxidation or diffusion/fixation group 18, at least a second dyeing group 20 of yarn 100, in turn provided with a relative second squeezing device 22 of such a yarn 100.

At least the first dyeing group 14, the first squeezing device 16, the oxidation or diffusion/fixation group 18 and the second dyeing group 20 are enclosed by at least an upper hermetically sealed covering case 24, integral with the main body 12. Each covering case 24 may be made integrally with the main body 12, or it may be removably fixed to the main body 12 through the interposition of seals 70.

At least part of the covering cases 24 is provided, on at least part of the lateral surfaces of such a covering case 24, with a plurality of doors 26 that open and are resealable. Doors 26 are to be opened in the case of dyeing in the air. The covering case 24 may also be provided with at least one outlet device or at least one outlet opening 28 for the yarn 100, through which said yarn 100 exits from the dyeing apparatus 10 in case of dyeing under nitrogen, while ensuring the sealed closure of the covering case 24.

As shown in FIG. 1, which illustrates the dyeing apparatus 10 configured to carry out a traditional dyeing in the air, yarn 100 is fed from left to right, with reference to the representation of the dyeing apparatus 10, in the direction of arrows F. Yarn 100 is then introduced into the first dyeing group 14 through a respective inlet opening 30 with a watertight wall obtained into the main body 12, and passing on a respective guide roller 32. The first dyeing group 14 comprises a respective first dye tank 34 into which yarn 100 is immersed, winding on a plurality of first return rollers 36. In the first dyeing tank 34, yarn 100 is immersed in a dye bath. The dye bath may be composed, for example, of an alkaline solution of indigo dye.

At the exit of the first dyeing tank 34, yarn 100 undergoes a first squeezing by passing between a pair of first squeezing rollers 38 of the first squeezing device 16. The first squeezing rollers 38 are the so-called squeezing "gadder".

Downstream of the first squeezing device 16, yarn 100 is introduced into the oxidation or diffusion/fixation group 18. The oxidation or diffusion/fixation group 18 comprises a plurality of upper return rollers 40 and a plurality of lower return rollers 42. The upper 40 and lower 42 return rollers are configured to arrange yarn 100, which is in continuous movement, on a plurality of vertical planes.

In the configuration of the dyeing apparatus 10 of FIG. 1, doors 26 of the covering case 24 are at least partially open. In the oxidation or diffusion/fixation group 18, the oxidation of yarn 100 takes place through exposure to air.

Downstream of the oxidation or diffusion/fixation group 18, yarn 100 is introduced into the second dyeing group 20. The second dyeing group 20 comprises a respective second dye tank 44 into which yarn 100 is immersed, winding on a plurality of second return rollers 46.

The second dyeing tank 44 is internally provided with a wall 68, configured to divide said second dyeing tank 44 into two separate volumes 44A and 44B. Preferably, the first volume 44A is greater than the second volume 44B. In the case of dye in the air, both volumes 44A and 44B of the second dyeing tank 44 are filled with the dye bath and are used simultaneously. In the case of dyeing under nitrogen, the second volume 44B of the second dyeing tank 44 is arranged to contain a quantity of dye bath less than the quantity of dye bath contained in the first dyeing tank 34. At the exit of the second dyeing tank 44, yarn 100 undergoes a second squeezing by passing between a pair of second squeezing rollers 48 of the second squeezing device 22.

Figure 4:
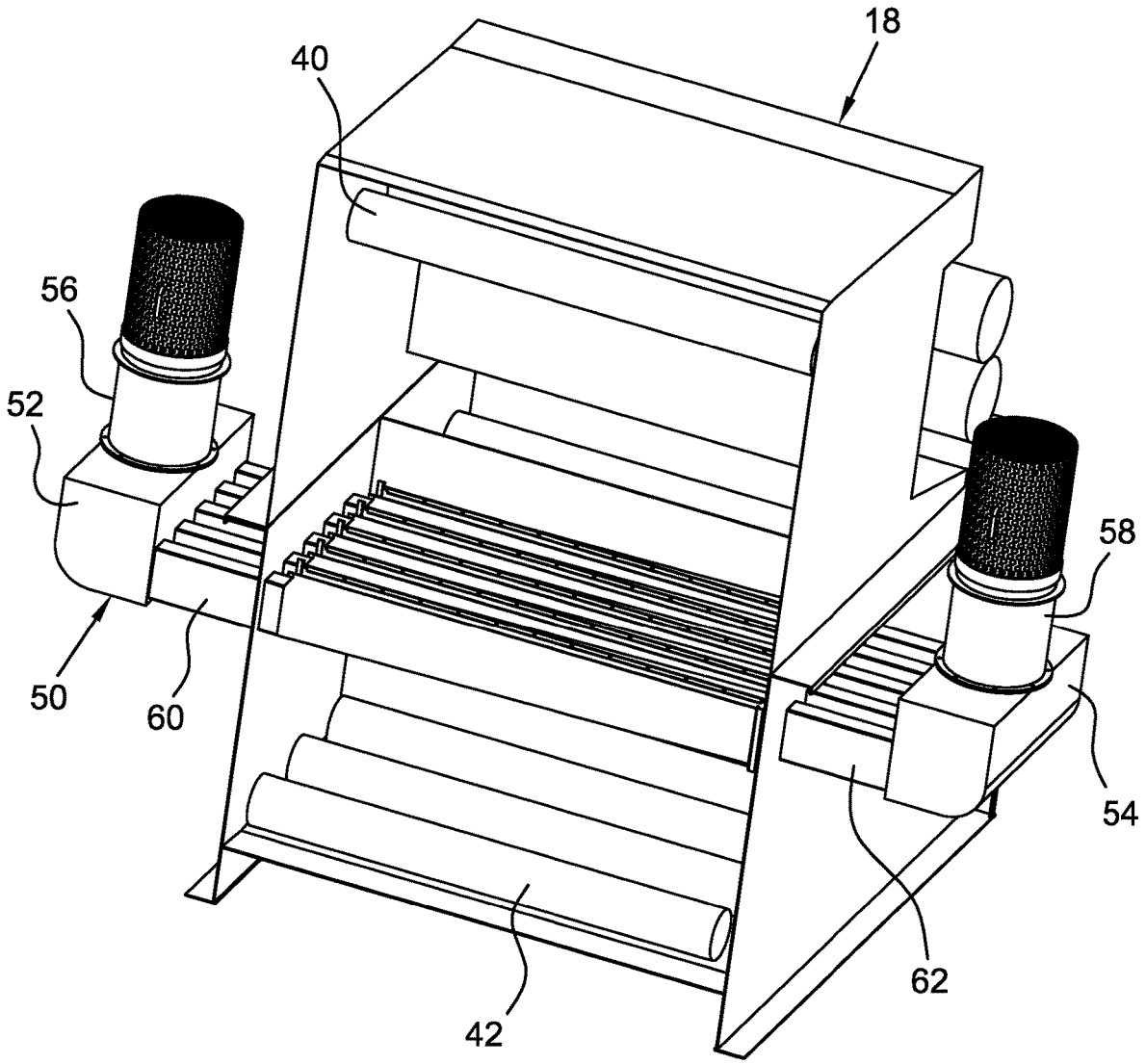
FIG. 4 is an isometric sectional view of an oxidation intensifier device applied in the central group of the dyeing apparatus of FIG. 1.
Figure 5:
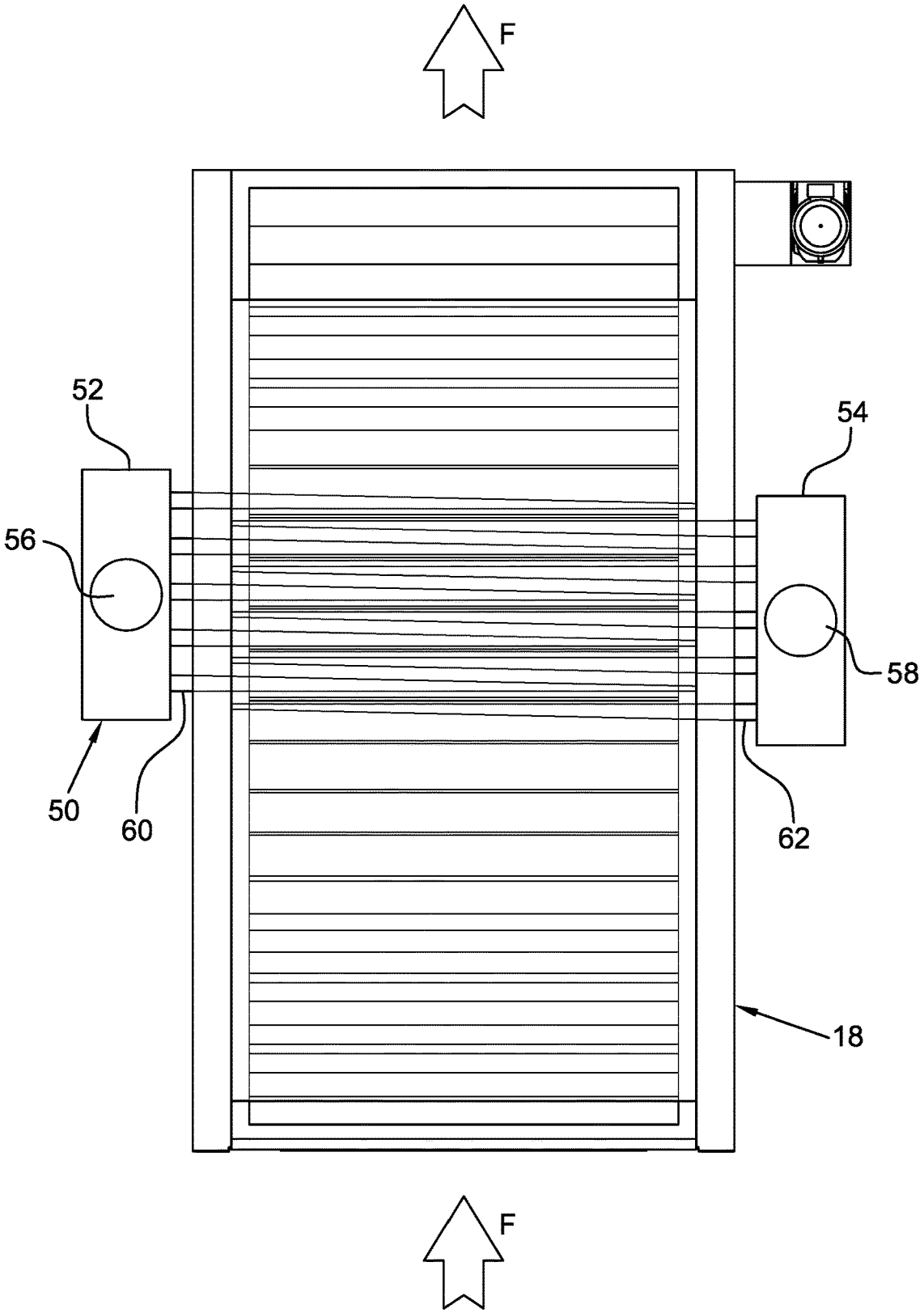
FIG. 5 is a plan view of the dyeing apparatus of FIG. 1 provided with the oxidation intensifier device of FIG. 4.

The oxidation or diffusion/fixation group 18 is provided with one or more respective oxidation intensifier devices 50, configured to generate a plurality of air flows that facilitate the oxidation process of the yarn 100. As shown in FIGS. 4 and 5, each oxidation intensifier device 50 may be composed, for example, of two blowing groups 52 and 54 having a substantially identical shape and opposed one another. Each blowing group 52 and 54 is provided with a respective fan 56 and 58 as well as a respective plurality of convergent ducts 60 and 62, arranged downstream of the respective fan 56 and 58 and preferably arranged equally spaced from each other and along development directions that are transversal to the feeding direction of yarn 100 in the dyeing apparatus 10. Each oxidation intensifier device 50 can be deactivated and isolated from the oxidation or diffusion/fixation group 18 by known means in order to arrange the dyeing apparatus 10 to carry out dyeing under nitrogen.

Figure 2:
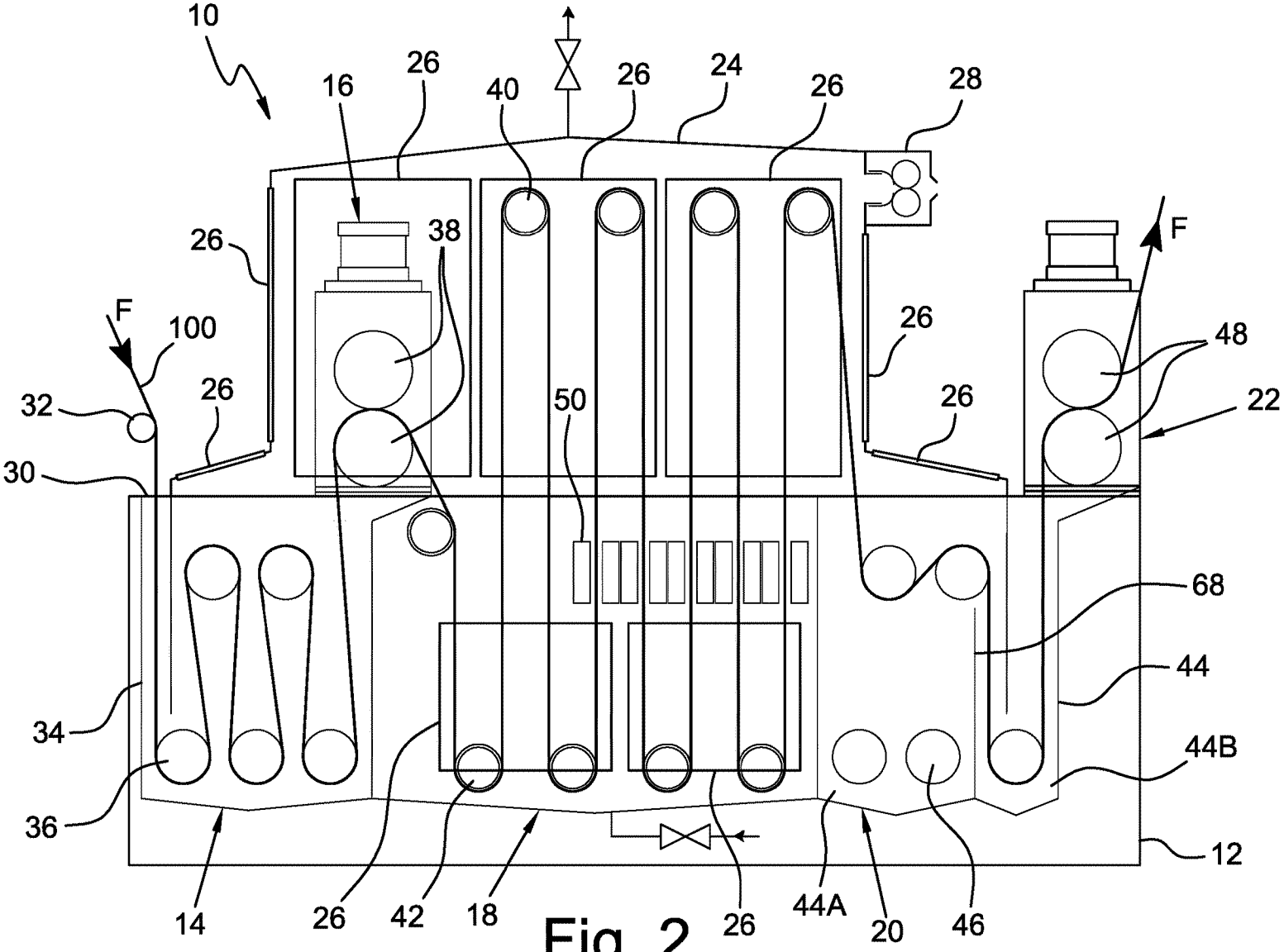
FIG. 2 is a schematic, side elevation view of the dyeing apparatus of FIG. 1, with the yarn fully threaded in the first two groups of the apparatus itself and only partially in the second compartment of the second dyeing tank, and with the lateral windows sealably closed, for dyeing under nitrogen.

FIG. 2 shows the dyeing apparatus 10 configured to carry out dyeing in an inert atmosphere under nitrogen. In this operating configuration, yarn 100 is threaded and completely immersed in the first dyeing group 14 and is threaded in the oxidation or diffusion/fixation group 18, while such a yarn 100 is only partially threaded in the second dyeing group 20. In other words, yarn 100 is threaded only in the second volume 44B of the second dyeing tank 44 and only this second volume 44B is filled with a respective dye bath.

In the configuration of the dyeing apparatus 10 of FIG. 2, doors 26 of the covering case 24 are completely sealably closed. In the oxidation or diffusion/fixation group 18 then the diffusion and fixation of the dye on the fiber of yarn 100 take place due to the presence of nitrogen within such an oxidation or diffusion/fixation group 18.

Figure 3:
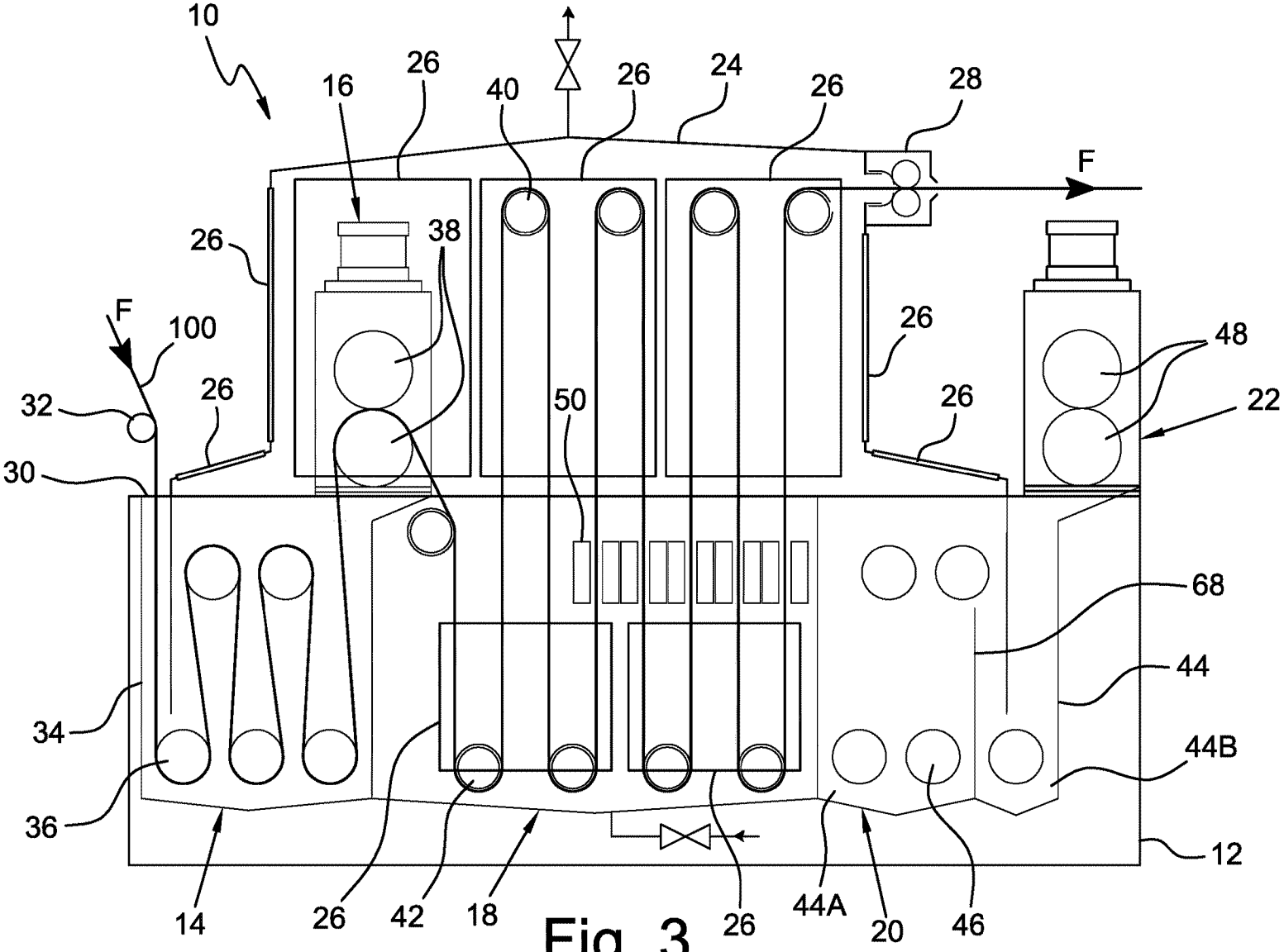
FIG. 3 is a schematic, side elevation view of the dyeing apparatus of FIG. 1, with the yarn fully threaded only in the first two groups of the apparatus itself, with output of the yarn from the sealing device and with the lateral windows sealably closed, for dyeing under nitrogen. In this configuration, the second dyeing tank of the second dyeing group is filled with water, with sealing function to prevent leakage of nitrogen.

FIG. 3 shows the dyeing apparatus 10 configured to carry out dyeing in an inert atmosphere under nitrogen based on a further operating configuration. In this operating configuration, yarn 100 is threaded and completely immersed in the first dyeing group 14 and is threaded in the oxidation or diffusion/fixation group 18. In this operating configuration, however, yarn 100 does not undergo additional dyeing steps and is arranged to directly exit from the oxidation or diffusion/fixation group 18 through the respective outlet device 28. In other words, yarn 100 is not introduced into the second dyeing group 20, while the second volume 44B of the second dyeing tank 44 is filled with water that only has a function of hydraulic seal to prevent the leakage of nitrogen from the oxidation or diffusion/fixation group 18 and, thus, from the dyeing apparatus 10.

Figure 7:
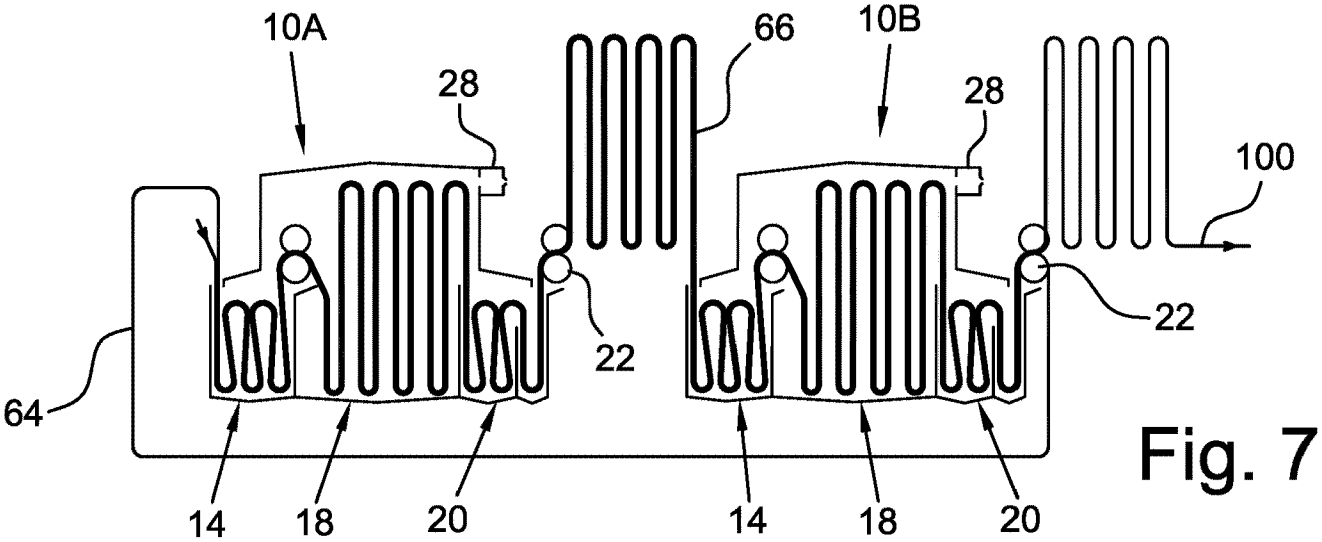
FIG. 7 is a side elevation view of two multifunctional continuous dyeing apparatuses for yarn chains according to the present disclosure, forming a dyeing plant, with the yarn threaded in all the groups of the apparatuses themselves, and with the lateral windows open. In this dyeing plant, after the fourth dyeing the yarn is returned to the first tank of the first apparatus to repeat four more steps, thus doubling the number of dyes.

FIG. 7 shows a continuous dyeing plant for yarn chains, comprising two separate dyeing apparatuses 10A and 10B arranged in series. This dyeing plant is arranged to subject yarn 100 to a first dyeing process carried out in a sequence in the first dyeing apparatus 10A and in the second dyeing apparatus 10B. Between the second squeezing device 22 of the second dyeing apparatus 10B and the first dyeing group 14 of the first dyeing apparatus 10A is interposed a return path 64 for yarn 100, configured to make such a yarn 100 repeat at least a second dyeing process again carried out in a sequence in the first dyeing apparatus 10A and in the second dyeing apparatus 10B.

In the configuration in FIG. 7, yarn 100 is threaded in all the respective groups 14, 18 and 20 of the first dyeing apparatus 10A and of the second dyeing apparatus 10B. Both dyeing apparatuses 10A and 10B have the respective doors 26 open. The dyeing plant is therefore arranged to carry out the traditional dyeing in the air.

In detail, in the first dyeing group 14 of the first dyeing apparatus 10A, a first dyeing step of yarn 100 is carried out, followed by a squeezing step and an oxidation step in the oxidation or diffusion/fixation group 18 of such a first dyeing apparatus 10A. In the second dyeing group 20 of the first dyeing apparatus 10A, a second dyeing step of yarn 100 is then carried out, followed by a squeezing step and an oxidation step in an external path 66 interposed between the first dyeing apparatus 10A and the second dyeing apparatus 10B.

In the first dyeing group 14 of the second dyeing apparatus 10B, a third dyeing step of yarn 100 is then carried out, followed by a squeezing step and an oxidation step in the oxidation or diffusion/fixation group 18 of such a second dyeing apparatus 10B. In the second dyeing group 20 of the second dyeing apparatus 10B, a fourth dyeing step of yarn 100 is then carried out, followed by a squeezing step and a return step of such a yarn 100 to the first dyeing apparatus 10A through the return path 64. This return path 64 also has function of oxidizer.

Figure 6:
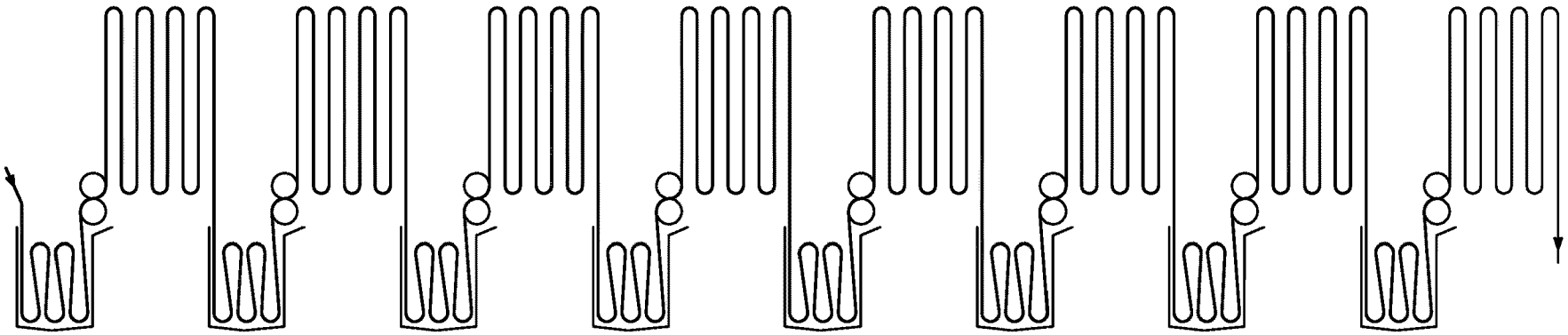
FIG. 6 is a side elevation view of only the dyeing tanks of a traditional continuous dyeing plant with indigo.

The above process in air is then repeated at least once, thus obtaining a fifth, a sixth, a seventh and an eighth dyeing step of yarn 100, interspersed with respective squeezing and oxidation steps. This dyeing process is perfectly identical to the traditional one, which can be obtained for example in the eight dyeing tanks of the dyeing plant of known type shown in FIG. 6, but with an evident saving in terms of size of the plant and, therefore, of space, cost, installed power, volumes of dye baths, etc.

Figure 8:
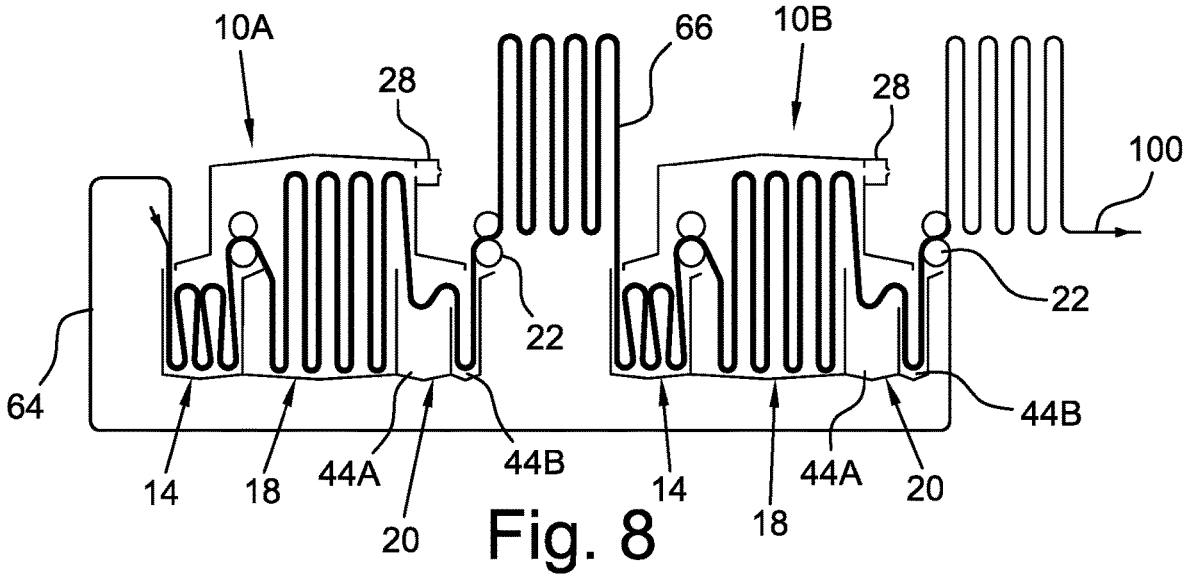
FIG. 8 is a side elevation view of two multifunctional dyeing apparatuses according to the present disclosure, forming a dyeing plant, with the yarn fully threaded in the first two groups and only in the second compartment of the second dyeing tank for each apparatus, and with the lateral windows sealably closed, for dyeing under nitrogen. This dyeing plant can be used in line (4 dyes), due to the possibility of working with more concentrated baths and thus with few tanks, or alternatively with the return to the first tank of the dyed yarn exiting from the fourth tank, threaded only in the second compartment, for doubling the dyes (8 dyes)

In the configuration of FIG. 8, yarn 100 is fully threaded in the first two groups 14 and 18 and only in the second volume 44B of the second dyeing tank 44 for each one of the first dyeing apparatus 10A and the second dyeing apparatus 10B. Both dyeing apparatuses 10A and 10B have the respective doors 26 hermetically closed. The dyeing plant is therefore arranged to carry out dyeing under nitrogen.

In detail, in the first dyeing group 14 of the first dyeing apparatus 10A, a first dyeing step of yarn 100 is carried out, followed by a squeezing step and a diffusion/fixation step of the dye on such a yarn 100 in the oxidation or diffusion/fixation group 18 of such a first dyeing apparatus 10A. In the second dyeing group 20 of the first dyeing apparatus 10A, a second dyeing step of yarn 100 is then carried out (with short threading in the second volume 44B of the second dye tank 44 only, i.e. with a shorter threading than the maximum threading that yarn 100 can have throughout the second dyeing group 20), followed by a squeezing step and an oxidation step in an external path 66 exposed to air and interposed between the first dyeing apparatus 10A and the second dyeing apparatus 10B.

In the first dyeing group 14 of the second dyeing apparatus 10B, a third dyeing step of yarn 100 is then carried out, followed by a squeezing step and a diffusion/fixation step of the dye on such a yarn 100 in the oxidation or diffusion/fixation group 18 of such a second dyeing apparatus 10B. In the second dyeing group 20 of the second dyeing apparatus 10B, a fourth dyeing step of yarn 100 is then carried out (again with short threading in the second volume 44B of the second dyeing tank 44 only), followed by a squeezing step and a return step of such a yarn 100 to the first dyeing apparatus 10A through the return path 64. This return path 64 also has function of oxidizer.

The above process under nitrogen may then be repeated at least once, thus obtaining a fifth, a sixth, a seventh and an eighth dyeing step of yarn 100, interspersed with respective diffusion/fixation and oxidation steps. With the dyeing plant in the configuration of FIG. 8 it is therefore possible to carry out four dyeing steps if the plant is used in line, or eight dyeing steps if the return path 64 is also used.

Figure 9:
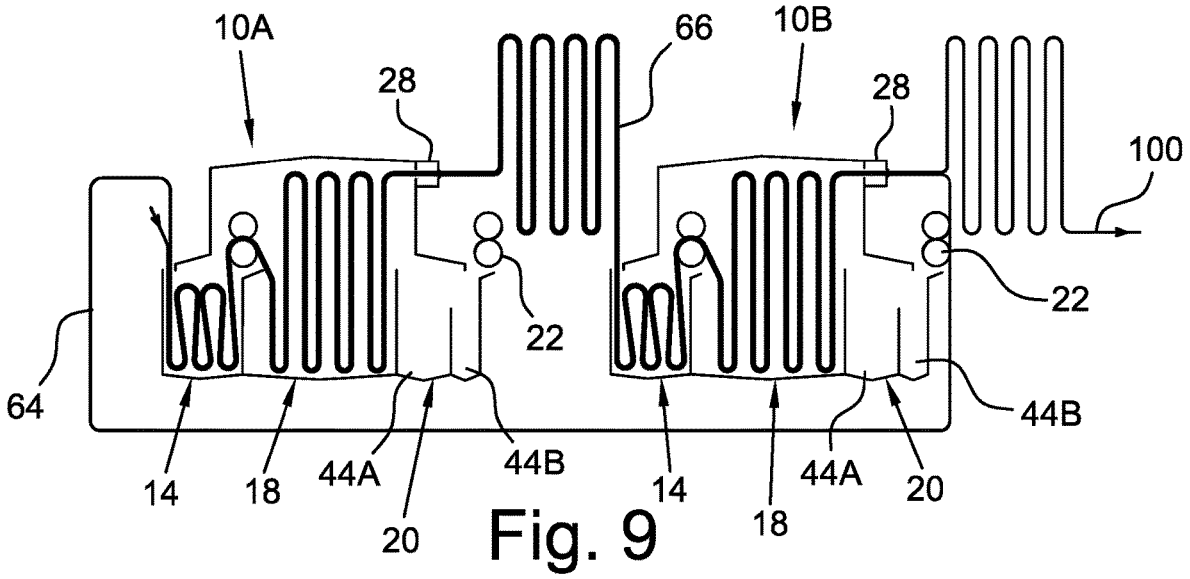
FIG. 9 is a side elevation view of two multifunctional dyeing apparatuses according to the present disclosure, forming a dyeing plant, with the yarn fully threaded in the first two groups and with exit of the yarn itself from the sealing device for each apparatus, and with the lateral windows sealably closed, for dyeing under nitrogen. This dyeing plant can be used in line (4 dyes), due to the possibility of working with more concentrated baths and thus with few tanks, or alternatively with the return to the first tank of the dyed yarn exiting from the fourth tank, threaded only in the second compartment, for doubling the dyes (8 dyes)

In the configuration of FIG. 9, yarn 100 is fully threaded in the first two groups 14 and 18 of each one of the first dyeing apparatus 10A and the second dyeing apparatus 10B. Yarn 100 therefore exits from each dyeing apparatus 10A and 10B through the outlet devices 28 of the respective covering cases 24. Both dyeing apparatuses 10A and 10B have the respective doors 26 hermetically closed, while the second volume 44B of the second dyeing tank 44 of each dyeing apparatus 10A and 10B is filled with water. The dyeing plant is therefore arranged to carry out dyeing under nitrogen.

In detail, in the first dyeing group 14 of the first dyeing apparatus 10A, a first dyeing step of yarn 100 is carried out, followed by a squeezing step and a diffusion/fixation step of the dye on such a yarn 100 in the oxidation or diffusion/fixation group 18 of such a first dyeing apparatus 10A. Yarn 100 then comes out from the first dyeing apparatus 10A to undergo an oxidation step in an external path 66 exposed to air and interposed between the first dyeing apparatus 10A and the second dyeing apparatus 10B.

In the first dyeing group 14 of the second dyeing apparatus 10B, a second dyeing step of yarn 100 is then carried out, followed by a squeezing step and a diffusion/fixation step of the dye on such a yarn 100 in the oxidation or diffusion/fixation group 18 of such a second dyeing apparatus 10B. Yarn 100 then comes out of the second dyeing apparatus 10B to be returned until the first dyeing apparatus 10A through the return path 64. This return path 64 also has function of oxidizer.

The above second process under nitrogen may then be repeated at least once, thus obtaining a third and a fourth dyeing step of yarn 100, interspersed with respective squeezing, diffusion/fixation and oxidation steps. With the dyeing plant in the configuration of FIG. 9 it is therefore possible to carry out two dyeing steps if the plant is used in line, or four dyeing steps if the return path 64 is also used.

It should be noted that the ring system provided with the return path 64, compared to patent GB 1430154, is conceptually and technically applied differently. In fact, in addition to the dyeing processes described above, other variations are possible depending on the number of dyeing apparatuses 10 used, which can be one or even more than two. Of course, the indicative cycles of the dyeing processes above can be integrated with traditional manufacturing operations of denim fabric, such as caustic soda pre-treatment, pre-dyeing, over-dyeing, etc.

It is also noted that each covering case 24, and consequently the shape and the capacity of the two dyeing groups 14 and 20 (which may comprise one or more dyeing tanks 34, 44) and of the intermediate oxidation or diffusion/fixation group 18 can be achieved in various ways according to the production or dyeing requirements. Therefore, a minimum or higher content of yarn 100 may be employed for dyeing and/or the diffusion/fixation and/or the oxidation of the dye, with or without the nitrogen seal outlet device 28 to make such a yarn 100 exit from the dyeing apparatus.

Figure 10:
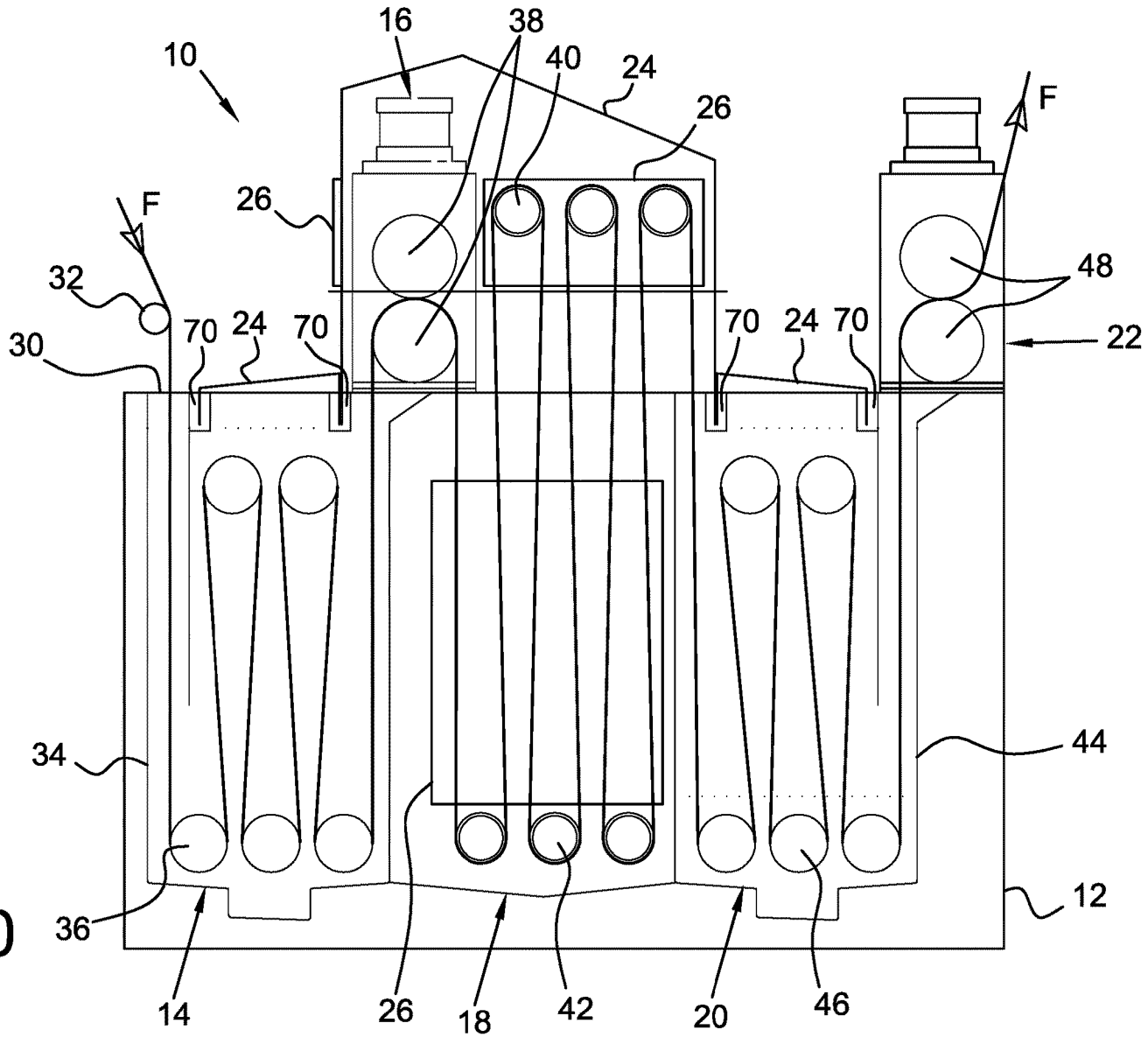
FIGS. 10 to 15 show respective embodiments of the multifunctional continuous dyeing apparatus for yarn chains according to the present disclosure.
Figure 11:
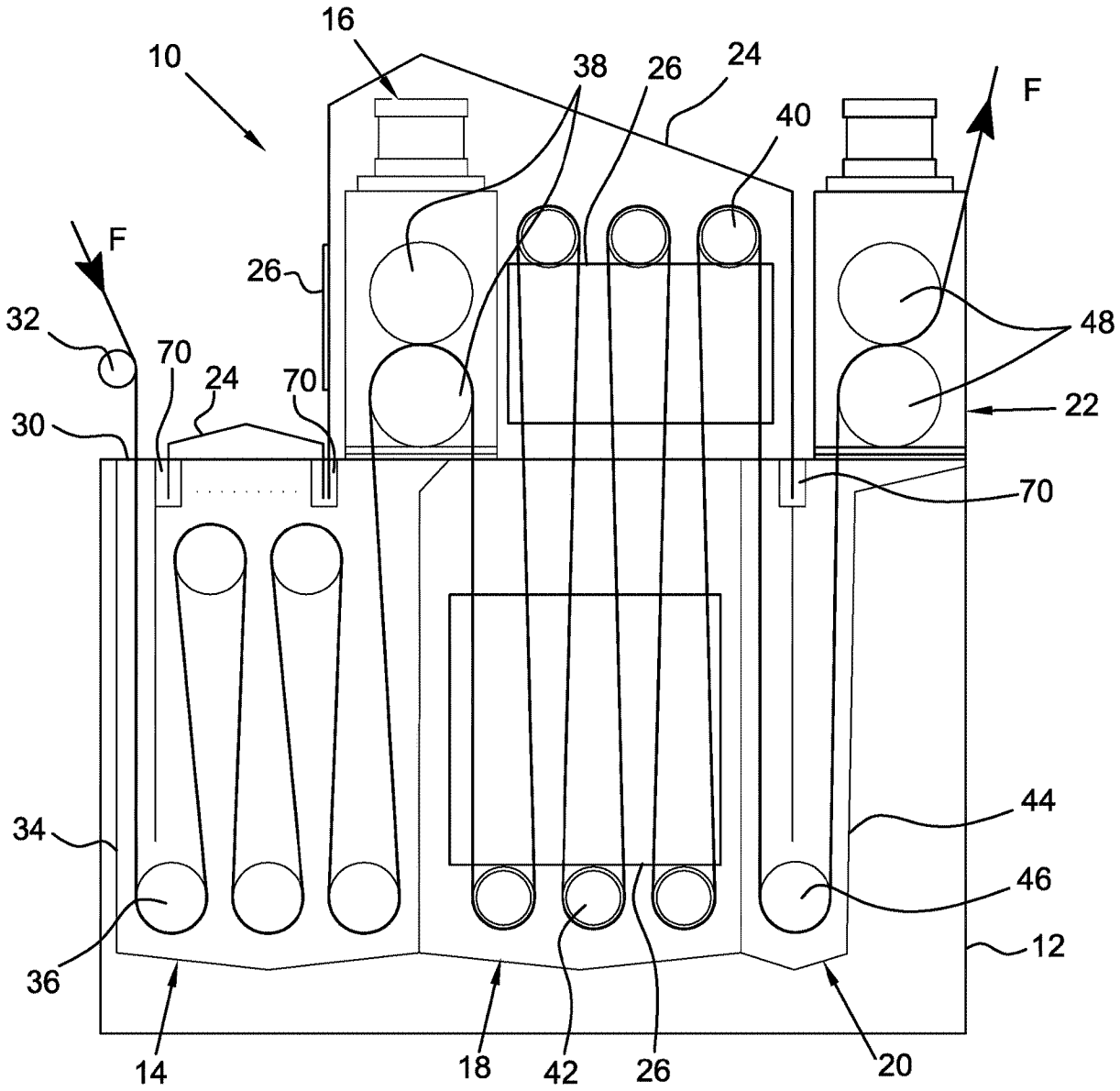
Figure 12:
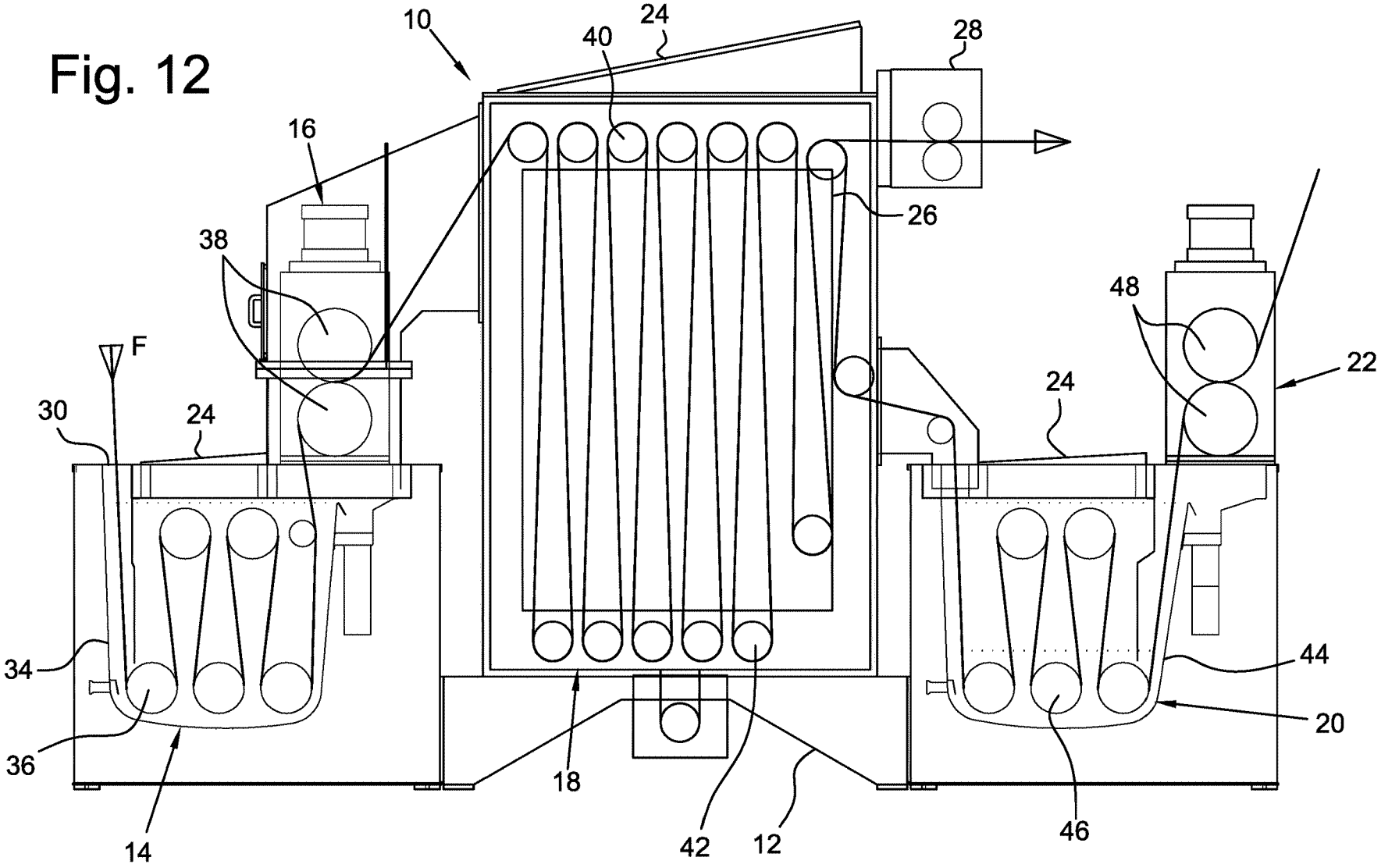
Figure 13:
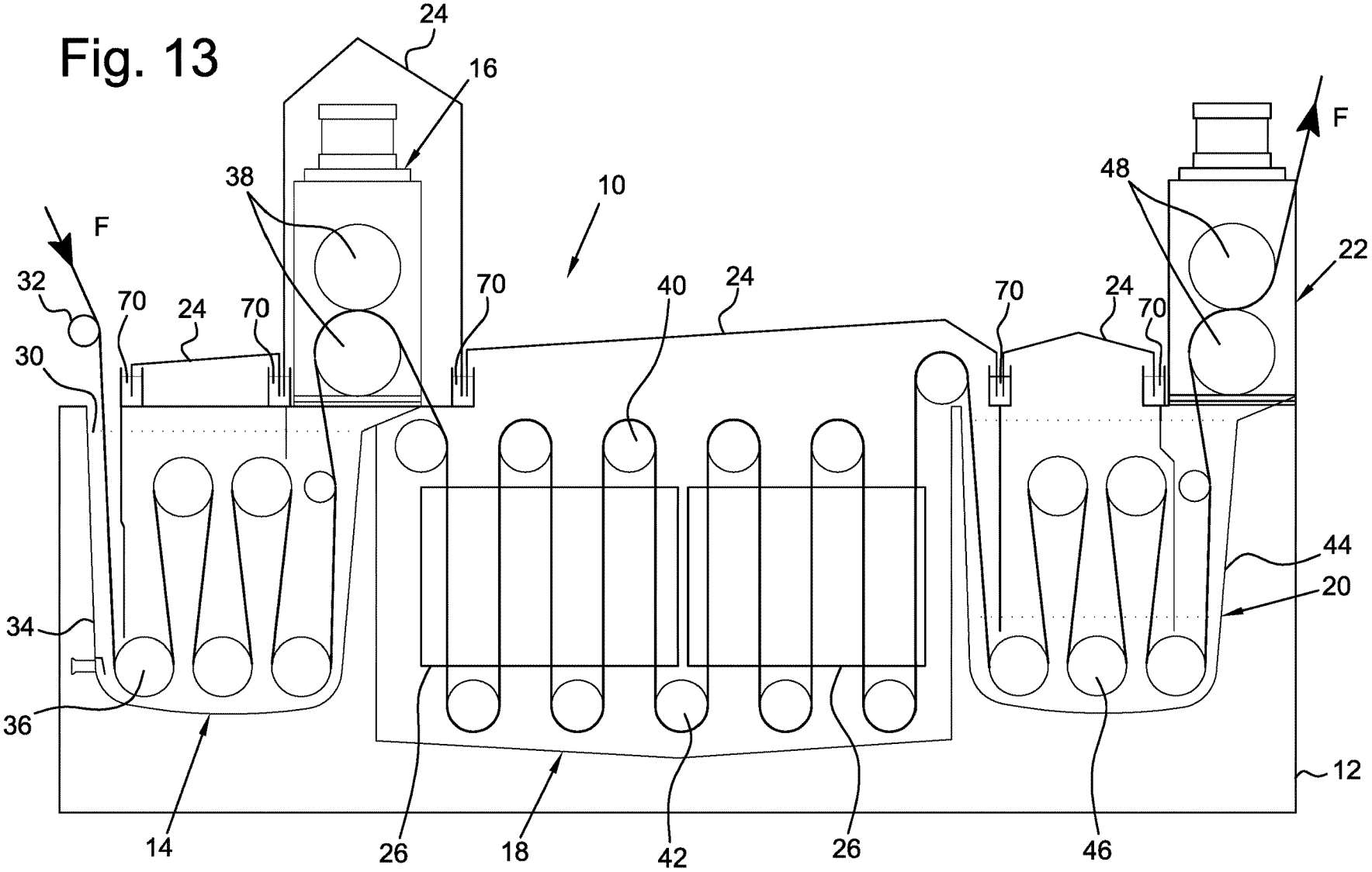
Figure 14:
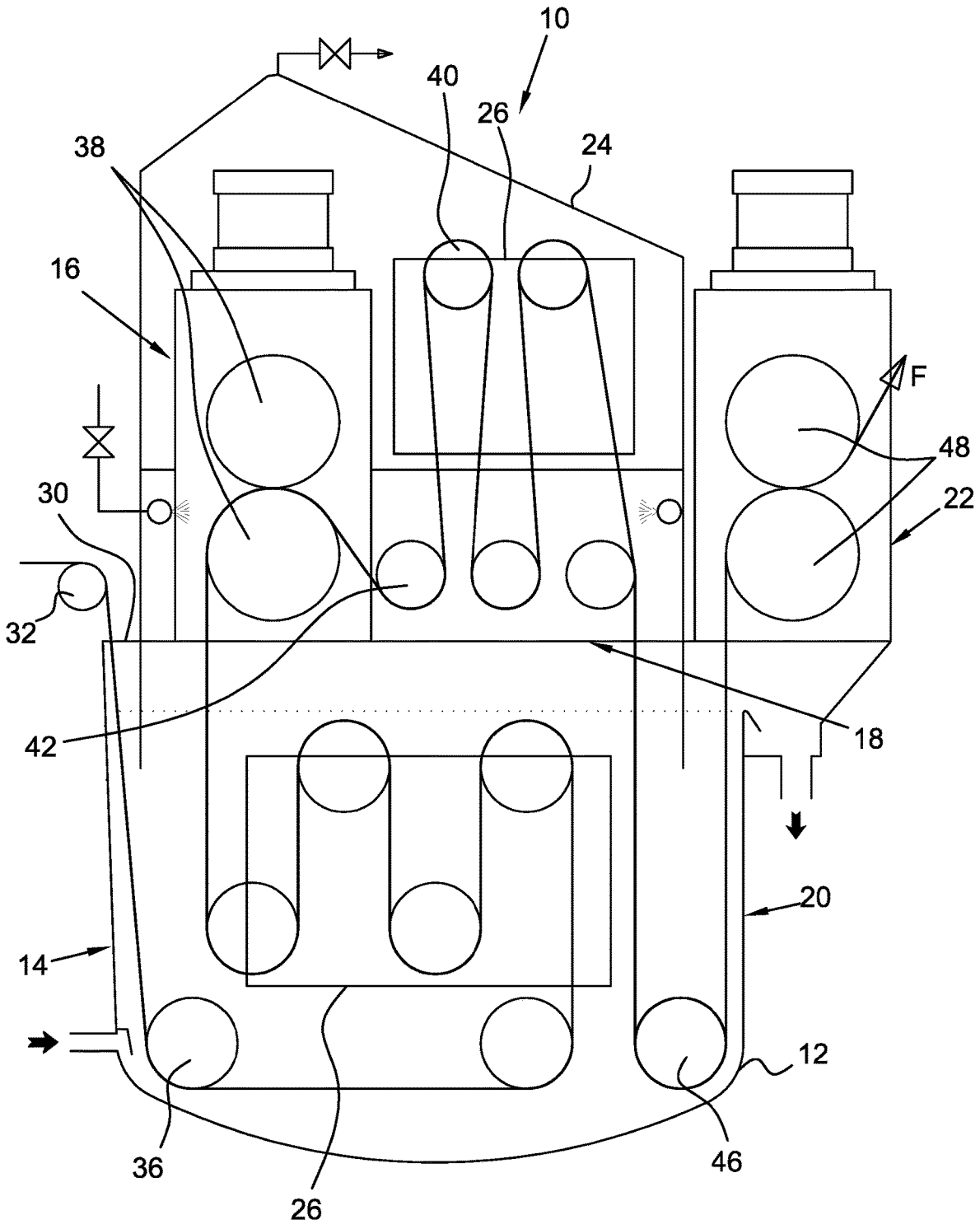
Figure 15:
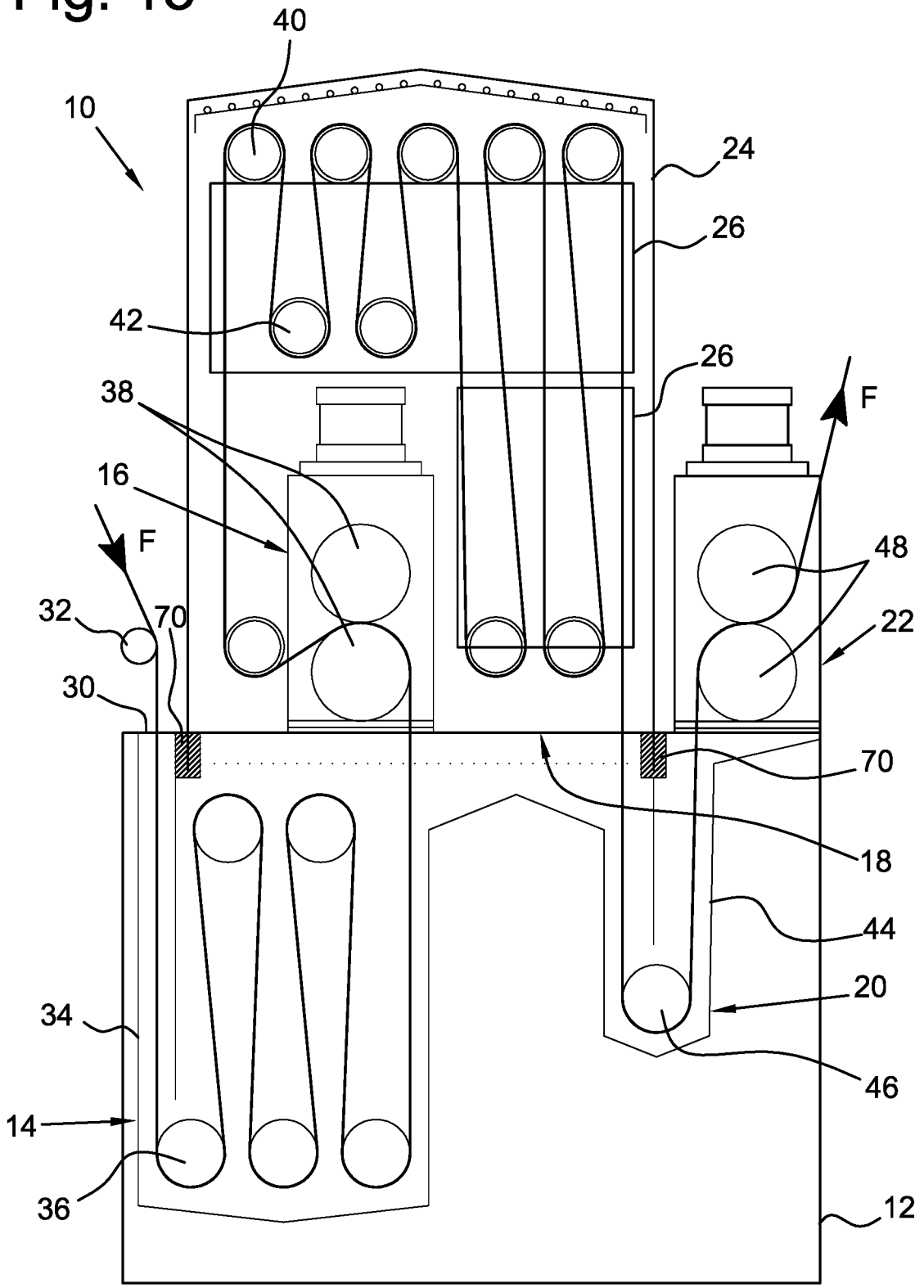

By way of example, some of these possible variations of the dyeing apparatus 10, which all fall under the protection scope of the disclosure, are shown in the accompanying FIGS. 10 to 15. In particular, the apparatuses of FIGS. 10 and 11 are both configured to dye fabric rope warp chains. The apparatus in FIG. 12 is configured to dye fabric flat warp chains. The apparatus in FIG. 13 is ideal for the inclusion in standard dyeing plants for dyeing with sulphur black dye. The apparatuses in FIGS. 14 and 15 with the two dyeing groups 14 and 20 comprising a single tank suitably shaped, are very simple, inexpensive and small in size, which facilitates their inclusion in existing dyeing plants.

It has thus been seen that the multifunctional continuous dyeing apparatus for warp chains according to the present disclosure achieves the objects described above. The multifunctional continuous dyeing apparatus for warp chains according to the present disclosure achieves the objects mentioned in the preamble of the description and, unlike the plants and processes used to date in dyeing with indigo, not only has greater operating flexibility but also allows significantly reducing the number of treatment tanks and, consequently, the costs of plants, the installed power, the volumes of the dyeing baths as well as production waste during batch changes.

In case of use for dyeing in an inert environment, it should be noted that in order to have maximum flexibility over the end result in terms of corticality and fixation degree, in addition to the known physical and chemical variables, the apparatus above is also arranged to vary the bath-fiber contact time and the residence time in the diffusion/fixation group. The multifunctional dyeing apparatus according to the present disclosure further offers the possibility to dye small yarn batches, i.e. reduced yarn sizes, increasingly demanded by the market. It is in fact noted that in traditional plants, the minimum length of warp batches to dye is based on the length of the yarn which is the threading of the plant itself and, therefore, at every batch change the percentage of yarn to discard will be proportionately higher the shorter will be the batch.

The multifunctional continuous dyeing apparatus for warp chains of the present disclosure thus conceived can be subjected to numerous modifications and variants, all falling within the same inventive concept; moreover, all details may be replaced with technically equivalent elements. In the practice, the materials used as well as shapes and sizes, may be any, according to the technical requirements.

The scope of protection of the disclosure is therefore defined by the accompanying claims.

The invention claimed is:

1. Multifunctional continuous dyeing apparatus for a yarn, the dyeing apparatus being provided at a bottom with a main body inside which the following are obtained in sequence, with reference to a feeding direction of the yarn:

at least one first dyeing group configured for dyeing the yarn, provided with a corresponding first squeezing device configured for squeezing said yarn;

an oxidation or diffusion/fixation group, placed downstream of the at least one first dyeing group and arranged for the oxidation of the dyed yarn, or for the diffusion/fixation of the dye in the fiber of said dyed yarn;

wherein at least the at least one first dyeing group, the first squeezing device, and the oxidation or diffusion/fixation group are hermetically sealing enclosed by at least one covering case, integral at a top with the main body, wherein at least part of the at least one covering case is provided, on at least part of side surfaces of at least one covering case, with a plurality of doors, wherein said plurality of doors pass from an at least partially opening configuration, wherein said plurality of doors are at least partially open to perform the dyeing of the yarn in an environment exposed to air to a seal closing configuration wherein said plurality of doors are seal closed to perform the dyeing of said yarn in an inert environment, wherein the at least one covering case is provided with at least one outlet opening configured to let out said yarn from the dyeing apparatus when the dyeing of said yarn is performed in an inert environment, while ensuring the sealed closure of the at least one covering case, wherein the oxidation or diffusion/fixation group is provided with one or more respective oxidation intensifier devices configured to generate a plurality of air flows that facilitate the oxidation of the yarn.

2. Dyeing apparatus according to claim 1, wherein the at least one first dyeing group comprises a respective first dyeing tank, internally provided with a plurality of first return rollers on which the yarn winds and arranged to contain a dye bath in which said yarn is immersed.

3. Dyeing apparatus according to claim 1, wherein the oxidation or diffusion/fixation group comprises a plurality of upper return rollers and a plurality of lower return rollers configured to arrange the yarn, which is in continuous movement, on a plurality of vertical planes.

4. Dyeing apparatus according to claim 1, wherein each oxidation intensifier device is made of two blowing groups having substantially identical conformation and opposite one another, each blowing group being provided with at least one respective fan, as well as with a respective plurality of converging ducts placed downstream of the respective fan, arranged equidistant from one another and along development directions that are transversal to the feeding direction of the yarn into the dyeing apparatus.

5. Dyeing apparatus according to claim 1, wherein each oxidation intensifier device can be disabled and isolated from the oxidation or diffusion/fixation group in order to arrange the dyeing apparatus to perform dyeing in an inert environment.

6. Dyeing apparatus according to claim 2, wherein at least one second dyeing group comprises a respective second dyeing tank, internally provided with a plurality of second return rollers in which the yarn is immersed and which is arranged to contain a dye bath in which said yarn is immersed, said second dyeing tank also being internally provided with a partition element configured to divide said second dyeing tank into two separate volumes.

7. Dyeing apparatus according to claim 6, wherein one of the the two separate volumes of the second dyeing tank is arranged to contain a quantity of dye bath less than the quantity of dye bath contained in the first dyeing tank when the dyeing of said yarn is performed in an inert environment.

8. Dyeing apparatus according to claim 1, wherein an inlet opening with a watertight wall is obtained in the main body, opening through which the yarn is introduced into the at least one first dyeing group passing on a respective guide roller.

9. Continuous dyeing plant for dyeing a yarn, comprising at least one first dyeing apparatus and at least one second dyeing apparatus, the at least one first and at least one second dyeing apparatuses according to claim 1, said at least one first dyeing apparatus and said at least one second dyeing apparatus being arranged sequentially whereby said dyeing plant being arranged to subject the yarn to a first dyeing process performed in sequence in the at least one first dyeing apparatus and in the at least one second dyeing apparatus, a return path for the yarn being interposed between the corresponding squeezing device of the at least one second dyeing apparatus and the at least one first dyeing group of the at least one first dyeing apparatus, said return path being configured to make said yarn to repeat at least one second dyeing process still performed in sequence in the at least one first dyeing apparatus and in the at least one second dyeing apparatus.

10. Continuous dyeing process for dyeing a yarn through a dyeing apparatus according to claim 1, the process comprising:

immersing the yarn into said at least one first dyeing group containing a dye bath;

exerting a first squeezing on the yarn exiting from the dye bath of said at least one first dyeing group; and subjecting the yarn to an intermediate step in said oxidation or diffusion/fixation group, wherein said intermediate step in said oxidation or diffusion/fixation group is either a step of oxidation of the yarn in an environment exposed to air that is obtained through the at least partial opening of said plurality of doors, or a step of diffusion and fixation of the dye to the fiber of said yarn in an inert environment that is obtained through the seal closure of said plurality of doors.

11. Dyeing process according to claim 10, further comprising, after said step of oxidation of the yarn in an environment exposed to air, the steps of:

immersing the yarn into said at least one second dyeing group containing a dye bath; and exerting a second squeezing on the yarn exiting from the dye bath of said at least one second dyeing group.

12. Dyeing process according to claim 10, further comprising, after said step of diffusion and fixation of the dye to the fiber of said yarn in an inert environment, the steps of:

immersing the yarn with short threading, i.e. with a shorter threading than the maximum threading that yarn can have throughout the at least one second dyeing group into a predefined portion of said at least one second dyeing group, said at least one second dyeing group containing a dye bath of reduced volume; and exerting a second squeezing on the yarn exiting from the dye bath of said at least one second dyeing group.

13. Dyeing process according to claim 10, further comprising, before said step of diffusion and fixation of the dye to the fiber of said yarn in an inert environment, a step of at least partial filling with water said at least one second dyeing group, said water having a hydraulic seal function in order to avoid nitrogen leakage, and further comprising, after said step of diffusion and fixation of the dye to the fiber of said yarn in an inert environment, an outlet step of said yarn from the dyeing apparatus through at least one outlet opening provided in said oxidation or diffusion/fixation group.

14. Dyeing process according to claim 10, further comprising, at the end of said dyeing process, a step of return of the yarn to said at least one first dyeing group through a return path.

15. Dyeing apparatus according to claim 1, wherein at least one second dyeing group for the yarn, placed downstream of the oxidation or diffusion/fixation group and provided in turn with a corresponding second squeezing device for said yarn, wherein said at least one second dyeing group is placed inside said main body, wherein said at least one second dyeing group is hermetically sealing enclosed by the at least one covering case, integral at the top with the main body.

* * * * *